United States Patent [19]

Herriott

[11] Patent Number: 4,631,939

[45] Date of Patent: Dec. 30, 1986

[54] LOCK WITH LOCKING ELEMENTS MOVABLE BY A MAGNETIC KEY

[75] Inventor: Leslie V. Herriott, Wolverhampton, United Kingdom

[73] Assignee: Lowe & Fletcher Limited, United Kingdom

[21] Appl. No.: 755,554

[22] Filed: Jul. 16, 1985

Related U.S. Application Data

[63] Continuation of Ser. No. 470,596, Feb. 28, 1983, abandoned.

[30] Foreign Application Priority Data

Mar. 6, 1982 [GB] United Kingdom ..... 8206658

[51] Int. Cl.[4] ..... E05B 47/00

[52] U.S. Cl. ..... 70/276; 70/389; 70/413

[58] Field of Search ..... 70/276, 389, 413, 373–375

[56] References Cited

U.S. PATENT DOCUMENTS

| | | | |
|---|---|---|---|
| 3,234,767 | 2/1966 | Allander | 70/276 |
| 3,429,154 | 2/1969 | Schwartz | 70/375 |
| 3,935,720 | 2/1976 | Boving | 70/276 |
| 4,127,017 | 11/1978 | Perkut | 70/413 X |
| 4,228,667 | 10/1980 | Herriott | 70/276 |
| 4,472,953 | 9/1984 | Gater | 70/373 |
| 4,476,701 | 10/1984 | Herriott | 70/276 |

FOREIGN PATENT DOCUMENTS

| | | | |
|---|---|---|---|
| 2442108 | 4/1975 | Fed. Rep. of Germany | 70/373 |
| 2513500 | 10/1976 | Fed. Rep. of Germany | 70/276 |
| WO80/01586 | 8/1980 | PCT Int'l Appl. | 70/276 |
| 0620492 | 11/1980 | Switzerland | 70/276 |
| 531713 | 1/1941 | United Kingdom | 70/276 |
| 2017804 | 10/1979 | United Kingdom | 70/276 |
| 2083127 | 3/1982 | United Kingdom | 70/276 |

*Primary Examiner*—Robert L. Wolfe
*Assistant Examiner*—Russell W. Illich
*Attorney, Agent, or Firm*—Marshall, O'Toole, Gerstein, Murray & Bicknell

[57] ABSTRACT

A lock for operation by a magnetic key has some locking elements which are moved circumferentially from locking to releasing positions by the key and further locking elements which are moved axially by the key from locking to releasing positions.

8 Claims, 7 Drawing Figures

LOCK WITH LOCKING ELEMENTS MOVABLE BY A MAGNETIC KEY

This application is a continuation, of application Ser. No. 470,596, filed Feb. 28, 1983 now abandoned.

BACKGROUND OF THE INVENTION

From one aspect, the present invention relates to a lock comprising a plurality of magnetic elements and members defining respective paths along which the magnetic elements can move between respective releasing positions and locking positions, the magnetic elements obstructing operation of the lock when in their locking positions but not when in their releasing positions.

A lock of the kind preferred in our published British Patent Specification No. 1,572,091. The lock described in this published specification has three magnetic elements, each confined to a respective arcuate path with these paths being spaced apart along an axis of the lock. The lock provides a high degree of security under most circumstances, since the magnetic elements are urged by gravity away from their releasing positions and access to the magnetic elements by picking instruments inserted into a key-hole of the lock is prevented.

If the lock described in the aforesaid published specification is mounted with its axis vertical or can be oriented so that its axis is vertical, the paths to which the magnetic elements are confined will each be horizontal and the magnetic elements will not be biased to any particular position along these paths by gravity. In these circumstances, the lock is less secure than in other circumstances.

SUMMARY OF THE INVENTION

According to a first aspect of the invention, a lock of the kind described is characterised in that the loci of the centres of said magnetic elements when the elements move along their respective paths lie other than in respective planes which are parallel to each other.

In a lock having this characterising feature, movement of at least one of the magnetic elements along its path is affected by gravity, irrespective of the orientation of the lock. This increases the difficulty of moving the magnetic elements to their releasing positions without use of the proper key, as compared with the known lock hereinbefore mentioned, oriented so that the magnetic elements move along horizontal paths.

The aforementioned characterising feature may be achieved by providing three magnetic elements movable along mutually orthogonal rectilinear paths. Alternatively, the feature may be achieved by providing a pair of magnetic elements, one of which is movable along a rectilinear path and the other of which is movable along a curved path lying in a plane transverse to the path of the one element. In a further alternative arrangement, one of the magnetic elements may be confined to a curved path which does not lie in a plane.

According to an optional feature of the invention, there is provided a lock comprising a hollow outer member and an inner member disposed within the outer member and defining a key-receiving opening, wherein the outer member includes two complementary approximately semi-cylindrical parts and retaining means embracing said parts to maintain said parts in assembled relation with each other around the inner member.

According to another optional feature of the invention, there is provided a lock comprising a member defining an opening into which a key can be introduced to operate a lock by turning of the key and also defining an axis of the lock which extends along the opening, the lock further comprising an obstructing element mounted in said member for movement between an obstructing position nearer to the axis and in which it obstructs insertion of the key into and withdrawal of the key from the opening and a non-obstructing position further from the axis, means for moving the obstructing element around the axis with the key when the key is inserted into the opening and is turned, and means for maintaining the obstructing element in its obstructing position over a limited range of movement of the obstructing element around the axis.

According to a still further optional of the invention, there is provided a lock comprising inner and outer hollow members which are relatively rotatable when the proper key is inserted into the inner member through an aperture at an outer end of the inner member and co-operating cam formations on the inner and outer members to cause relative axial displacement of the members when relative rotation of the members occurs, wherein the cam formations are spaced considerably from said outer end of the inner member.

BRIEF DESCRIPTION OF THE DRAWINGS

An example of a lock embodying each aspect of the invention will now be described, with reference to the accompanying drawings, wherein.

DESCRIPTION OF THE PREFERRED EMBODIMENTS

Figure 2:
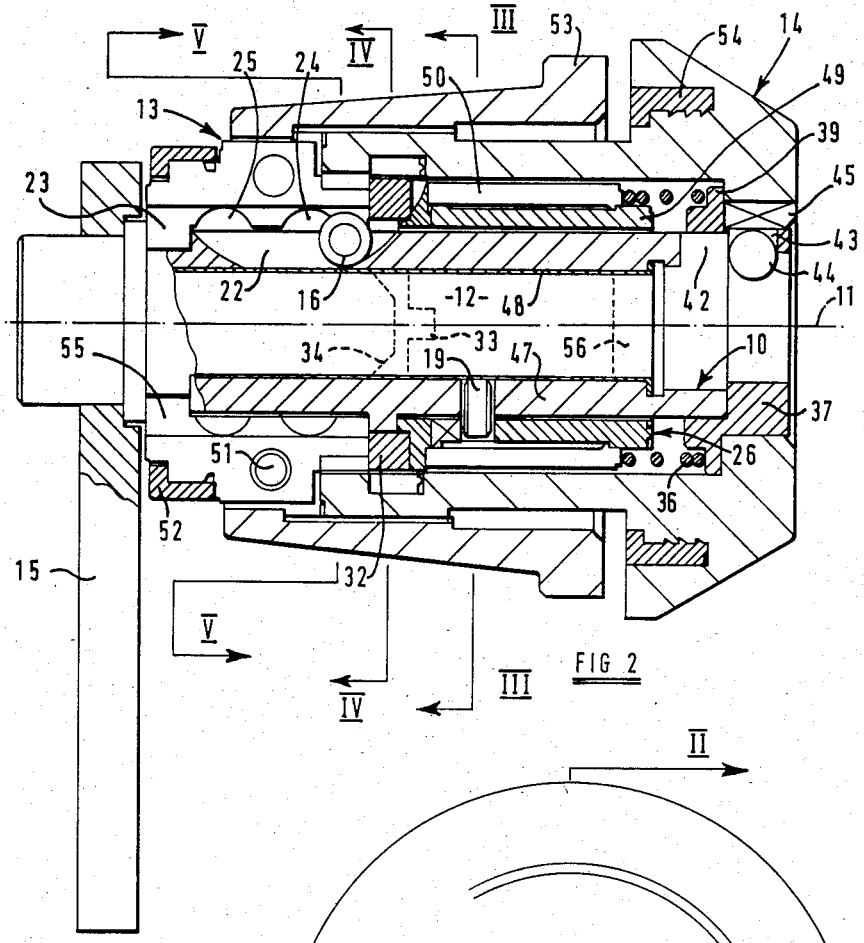
FIG. 2 shows a cross-section of the lock on the line II—II of FIG. 1.

The lock comprises a hollow, generally cylindrical inner member 10 which defines a longitudinal axis 11 of the lock. The inner member defines an elongated, generally cylindrical opening 12, along the centre of which the axis 11 extends. The inner member 10 is disposed within a hollow outer member 13 and is arranged for rotation relative to the outer member when a proper key is inserted into the opening 12. The outer member 13 is fixed in a housing 14 intended to be secured to a member which is to be locked or to a fixed structure (not shown).

At its inner end, the inner member 10 is provided with means for operating an associated device when the inner member is rotated relative to the housing 14. By way of example, there is shown a driving member 15 which projects radially from the inner member and is keyed to the inner member for rotation therewith. The driving member may be used to drive a bolt or other lockable element. In an alternative arrangement (not illustrated), there is provided on the inner member 10 a movable switch contact or means for moving a switch contact to operate an electrical switch controlled by the lock. In certain applications of the lock, the inner member 10 may be open at both ends.

For restraining rotation of the inner member 10 relative to the outer member 13 in the absence of the proper key, there are provided a plurality of magnetic locking elements. In the particular example illustrated, there are six locking elements, 16 to 21 respectively, and each of these is in the form of a roller having flat end faces and a cylindrical peripheral face. The rollers shown are hollow and open at both their ends.

Figure 5:
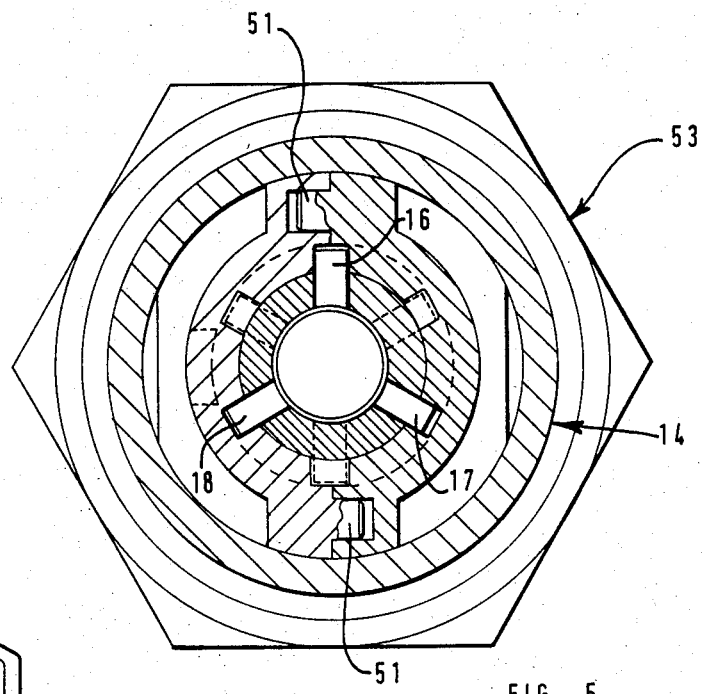
FIG. 5 shows a cross-section on the line V—V of FIG. 2.

The inner member 10 and outer member 13 collectively define for the rollers 16, 17 and 18 respective paths along which the rollers can move freely under the influence of gravitational and magnetic fields. In the example illustrated, each of these paths is substantially rectilinear and is parallel to the axis 11. As shown in FIG. 5, these paths are spaced apart equally around the axis. A part of the path for the roller 16 is provided by a slot 22 formed in the inner member 10, this slot having a longer dimension parallel to the axis 11 and a dimension extending circumferentially of the axis which is slightly greater than the corresponding dimension of the roller 16. The slot 22 extends along only a fraction of the length of the inner member 10 and is spaced from both the outer and inner ends thereof. The outer member 13 has in its internal surface a rectilinear channel 23 which may extend along the entire length of the outer member. This channel has the same width as and is aligned with the slot 22 so that approximately one half of the roller 16 runs in the slot and the other half runs in the channel. Movement of the roller along the channel is limited by the ends of the slot. As can be seen in FIG. 2, the dimension of the channel 23 which extends radially of the axis 11 is approximately equal to the radius of the roller 16 and the corresponding dimension of the slot 22 is slightly greater than the radius of the roller so that the roller can roll on the inner member 10 without the peripheral surface of the roller contacting the outer member.

The side walls of the slot 22 and channel 23 constitute abutment surfaces for the roller 16. When the roller is in the locking position illustrated in FIG. 2, engagement of these abutment surfaces with the roller prevents rotation of the inner member 10 relative to the outer member 13.

There are also formed in the inner surface of the outer member 13 channels of approximately semi-circular cross-section which extend around the axis 11 and intersect the channel 23. In the particular example illustrated, two such circumferential channels, 24 and 25 are provided. When the roller 16 is aligned with one or other of the channels 24 and 25, it is in a releasing position and no longer restricts rotation of the inner member 10 relative to the outer member. In the inner member is rotated, the roller is carried from the channel 23 into the channel 24 or 25, as the case may be. If there is no requirement to provide the lock with a master key, a single circumferential channel may be formed in the outer member.

The paths for the rollers 17 and 18 are formed in a manner corresponding to that in which the path for the roller 16 is formed and the circumferential channels 24 and 25 intersect the paths of the rollers 17 and 18 so that these rollers have releasing positions aligned circumferentially of the axis 11 with the releasing positions of the roller 16. This arrangement provides for rotation of the inner member 10 relative to the outer member 13 through an angle of 360°. In a case where more restricted relative rotation of the inner and outer members is acceptable, circumferential channels which subtend at the axis 11 correspondingly smaller angles can be provided and there may be provided for the rollers 16, 17 and 18 respective circumferential channels which do not lie at the same position along the axis 11.

Figure 3:
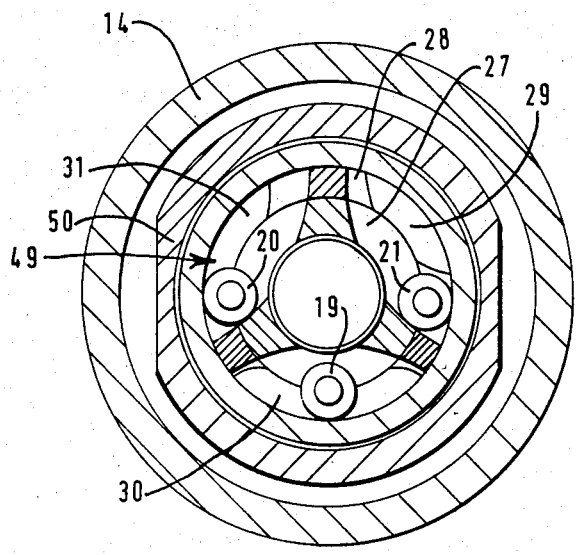
FIG. 3 shows a cross-section on the line III—III of FIG. 2.

Respective paths for the rollers 19, 20 and 21 are defined collectively by the inner member 10 and a sleeve 26 which extends around a part of the inner member positioned btween the outer member 13 and the outer end of the lock. These paths are curved, in the particular example shown, each being of arcuate form with the centre of curvature lying on the axis 11. As shown in FIG. 3, these paths are spaced apart equally about the axis 11.

A part of the path for the roller 21 is provided by a slot 27 in the inner member, the longer dimension of the slot extending circumferentially of the inner member and the dimension which extends along the axis 11 being slightly greater than the distance between the end faces of the roller. A further part of the path for the roller 21 is provided by a slot 28 in the sleeve 26. This slot 28 has the same width as and is aligned with the slot 27. Opposite walls of the slots 27 and 28 constitute abutment surfaces with which the end faces of the roller 21 overlap when the roller is in the locking position illustrated in FIG. 3. In one side wall of the slot 28, there is formed an opening 29 which can receive that part of the roller protruding from the slot 27 when the roller is moved to a releasing position. When in a locking position, by which we mean any position other than the releasing position, the roller 21 obstructs axial displacement of the sleeve 26 relative to the inner member 10. By means of a cam mechanism hereinafter described, rotation of the inner member relative to the outer member 13 is prevented unless axial displacement of the sleeve 26 relative to the inner member is permitted.

The paths for the rollers 19 and 20 are provided in a way similar to that in which the path for the roller 21 is provided and the sleeve 26 is formed with further openings 30 and 31 for receiving the rollers 19 and 20 when in their releasing positions.

It will be noted that the rollers 19, 20 and 21 overlap entirely with one another along the axis 11. If required, these rollers may be off-set from one another along this axis partly or entirely. Furthermore, we prefer to provide a further group of rollers (not shown) arranged in a manner similar to that of the rollers 19, 20 and 21 but spaced from those rollers along the axis. In this way, the number of combinations of releasing positions which are available in locks of the same general construction can be increased considerably.

The particular example of lock illustrated in the drawings has, near to an inner end of the lock, a group of rollers which move axially between locking and releasing positions and, spaced from that group in a direction towards an outer end of the lock, a group of rollers which move circumferentially between locking and releasing positions. In alternative arrangements, the rollers which move circumferentially may be nearer to the inner end of the lock than are the rollers which move axially. Furthermore, there may be more than two groups of rollers. For example, the lock may comprise three groups of rollers, each group being spaced along the lock from the other groups. The rollers of the middle group moving either circumferentially or axially between locking and releasing positions and the rollers of the other two groups moving axially or circumferentially between locking and releasing positions.

Figure 6:
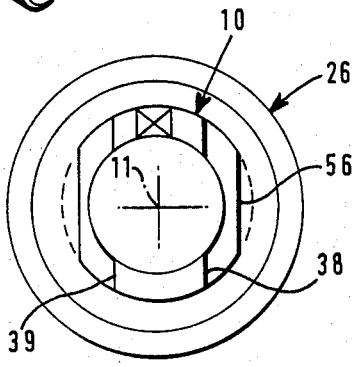
FIG. 6 shows assembled inner and outer members of the lock separated from other components and viewed from the outer end of the lock.

The sleeve 26 is constrained to rotate with the inner member 10 about the axis 11 by co-operation between respective flat surfaces on the sleeve and inner member. As shown in FIG. 6, in the preferred arrangement there are two flat surfaces on the exterior of the inner member 10, these being disposed at diametrically opposite positions but spaced one nearer to the axis 11 and one further from the axis. Corresponding flat internal surfaces are provided on the sleeve. With this arrangement, the sleeve will fit onto the inner member one way up only and correct assembly of the components is facilitated.

Figure 4:
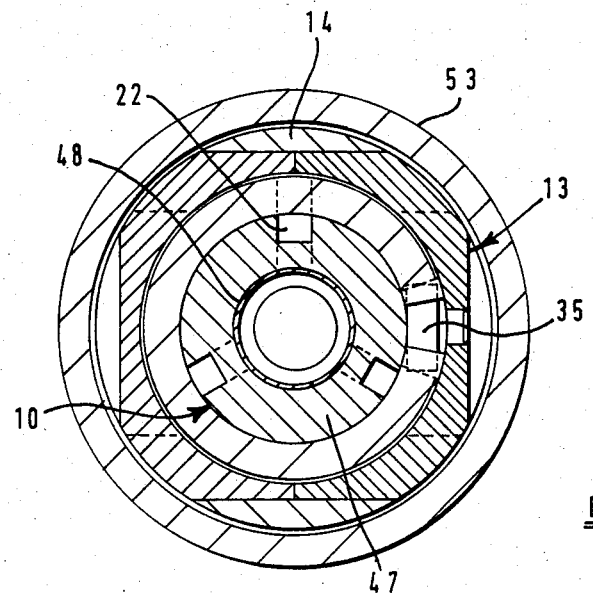
FIG. 4 shows a cross-section on the line IV—IV of FIG. 2.

The inner member 10 extends through a ring 32 disposed between the outer member 13 and the sleeve 26. This ring has an axially projecting tooth 33 which engages in a complementary recess in the adjacent end of the sleeve 26 to cause the ring to rotate about the axis 11 with the sleeve 26 and the inner member. In a face of the ring 32 presented towards the outer member 13, there is provided a female cam formation 34 which co-operates with a male cam formation 35 (see FIG. 4) on the outer member 13 to cause movement of the ring 32 and sleeve 26 along the axis 11 away from the outer member 13 whenever the inner member 10 is turned relative to the outer member from the initial position illustrated in the drawings, in which the key can be inserted into and withdrawn from the inner member. A spring 36 acting between a head 37 of the inner member and the sleeve 26 urges the sleeve and the ring 32 along the axis 11 towards the outer member 13 so that the tooth 33 is maintained in driving engagement with the sleeve and the cam formation 35 is maintained in engagement with the ring 32.

The head 37 is formed separately from the inner member 10 and fits onto an outer end portion of the inner member. Axially overlapping parts of the inner member and head are provided with respective flat surfaces parallel to the axis 11 for ensuring that the head and inner member rotate together about the axis 11. As shown in FIG. 6, in the preferred arrangement, there are two flat surfaces on the inner member, one of these, 38 being nearer to the axis 11 than the other surface 39 and a pair of correspondingly positioned flat surfaces being provided on the head 37 so that correct assembly of the head with the inner member is facilitated.

The head 37 is mounted in a circular opening formed in the housing 14 at the outer end thereof so that the head can rotate relative to the housing about the axis 11. The head includes a radially outwardly projecting flange 39 which bears against an internal surface of the housing to prevent the head and other internal components of the lock from being withdrawn from the housing through the opening at the outer end thereof.

Figure 7:
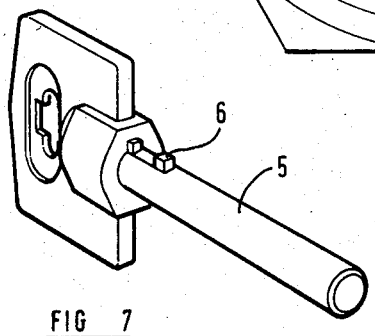
FIG. 7 shows a perspective view of a key for use with the lock.

The head 37 defines an aperture through which a key can be inserted into the opening 12. This aperture includes a generally circular portion 40 and a rectangular notch 41 extending outwardly from the periphery of the circular portion. As shown in FIG. 7, the key intended to be used with the lock shown in the drawings has a generally cylindrical shank 5 and, adjacent to a handle of the key, a driving lug 6 projecting radially outwardly of the shank. When the key is inserted, this lug passes through the notch 41 to engage in a corresponding notch 42 formed in the adjacent end portion of the inner member 10 so that the key can drive the inner member about the axis 11.

Figure 1:
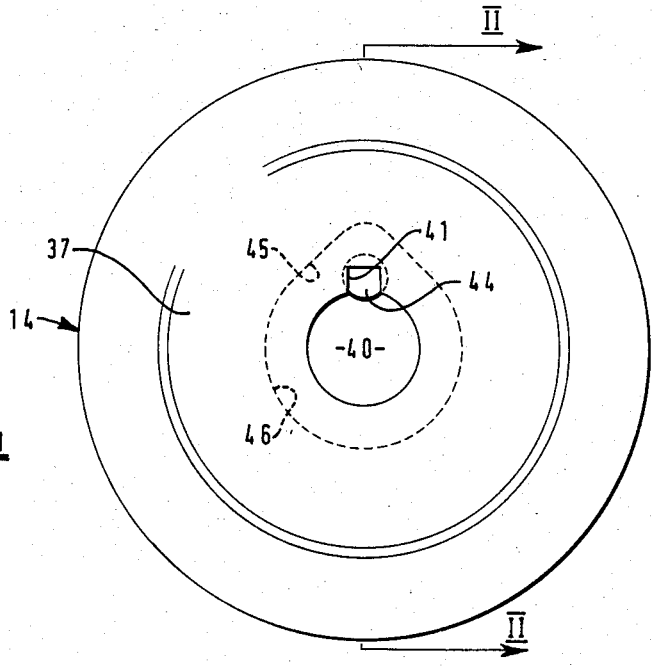
FIG. 1 shows an end of a lock, called herein the outer end.

There is formed in the head 37 a passage 43 which is spaced a short distance along the axis 11 from the outer end face of the head and extends from the notch 41 to the periphery of the head. In this passage, there is disposed an obstructing element 44 movable between an obstructing position illustrated in FIG. 1, in which the element obstructs the notch 41, and thus prevents insertion of the key into or withdrawal of the key from the inner member 10, and a non-obstructing position in which the element lies sufficiently far from the axis 11 to permit the driving lug of the key to pass between the element and the axis. The obstructing element is preferably adapted to roll on the driving lug of the key and, in the example illustrated, is in the form of a ball.

Adjacent to the head 37, the housing 14 is formed with a recess 45 for receiving the ball 44 when the ball is moved to its non-obstructing position whilst the inner member 10 is in the initial rotational position illustrated in the drawings. Between those boundaries of the recess 45 which are spaced apart circumferentially of the axis 11, there extends around the remainder of the periphery of the head a cylindrical surface 46 formed on the housing 14 and spaced from the axis 11 by a distance such that, when the inner member 10 is turned from its initial rotational position and the ball is carried around the axis 11 by the head 37 at the end of the inner member, the ball 44 is constrained to occupy its obstructing position.

As shown in FIG. 2, the inner member 10 is preferably a two-part assembly formed from a relatively thick-walled tube 47 and a thin-walled lining 48. The slots 27 and 28 are cut in the tube 47 before the lining 48 is applied to the tube. The lining is introduced from the inner end of the tube and, when properly positioned, an outer end portion of the lining is spread radially outwardly into an annular groove formed in the tube. This renders the lining a captive of the tube and the lining prevents access being gained to the rollers through the opening 12.

The sleeve 26 also is preferably formed as a two-part assembly from a tube 49 and a sheath 50. Cutting of the slots 28 is conveniently carried out by means of a milling cutter rotating about an axis parallel to the axis 11 and with the tubes 47 and 49 assembled together. The slots 27 and 28 are then cut together. The openings 29, 30 and 31 may be cut at the same time by a smaller diameter cutting surface on the milling cutter, or in a separate cutting operation. After the slots 28 and openings 29, 30 and 31 have been cut, the sheath 50 is applied to the tube 49 from the inner end thereof until a radially inwardly projecting rib on the sheath 50 snaps into a circumferential groove formed in the external surface of the tube 49. The rollers 19, 20 and 21 are inserted into their paths before the sheath is applied and the sheath then prevents escape of the rollers.

The outer member 13 also is conveniently a two-part assembly, these parts abutting in a plane which contains the axis 11, as shown in FIG. 5. The parts are formed with complementary projections 51 and recesses for maintaining the required alignment. The two parts may be identical one with the other. When these parts have been assembled together, a ring 52 is applied to a rear end portion of the outer member to embrace the parts and hold them together. End portions of these parts adjacent to the ring 32 may be held together by the housing 14 and have lugs which project in directions away from the axis 11 and are received in corresponding recesses in the housing to prevent withdrawal of the outer member 13 from the housing in a direction away from the head 37. To facilitate assembly, the housing 14 also is formed as a two-part assembly with the parts meeting in a plane containing the axis 11 and perpendicular to the plane in which the parts of the outer member 13 meet. The housing parts are retained in assembled relation by a nut 53 screwed onto the housing and a hardened ring 54 which is pressed into an annular recess in the housing after the housing has been assembled.

The components of the lock are not pinned together and there is no requirement to drill holes for pins.

At its inner end, the outer member 13 is formed with a radially inwardly projecting flange 55 against which a shoulder on the inner member 10 bears to prevent withdrawal of the inner member and head 37 from the housing in the inner axial direction.

The rollers 16 to 21 are formed of a magnetic material, for example mild steel, but are not permanently magnetised. They can be handled during assembly more easily than could magnetised elements. The outer member 13 and the housing 14 may be formed of di-cast, moulded or sintered parts and the tubes 47 and 49 are machined from non-magnetic metal. The sheath 50 may be formed of a plastics material. The ring 32 and the ball 44 are formed of hardened steel. The cam formation 35 also is preferably formed separately from the other components of the outer member 13 and may be hardened steel.

It will be noted that the cam formations 34 and 35 are remote from the outer end of the lock so that they are unlikely to be rendered ineffective if the lock is drilled from its outer end. The cam formations may be modified to cause relative axial movement in opposite directions when relative rotational movement in opposite directions occurs.

When the key is absent from the lock, the rollers 16 to 21 occupy locking positions to which they are biased by gravity. In order to be removed to their releasing positions, the rollers must be moved in different planes, at least some of the rollers being moved against the action of gravity. It will be noted that there is no single plane and no set of parallel planes which contains the entire loci of the centres of the rollers when the rollers move along their paths to their releasing positions.

When the key is introduced into the lock, the driving lug 6 of the key engages the ball 44 and moves the ball radially outwardly to its non-obstructing position. The lug then passes the ball and the ball drops back to its obstructing position behind the lug. The lug is then in driving engagement with the inner member 10 and a pemanent magnetic field associated with the shank of the key, which is disposed within the opening 12, biases the rollers 16 to 21 to respective releasing positions. With the rollers in their releasing positions, the inner member 10 can be rotated freely relative to the outer member through any angle. Until the inner member is returned to its initial rotational position, withdrawal of the key is prevented by engagement of the driving lug of the key with the ball 44, the ball being held in its obstructing position by the surface 46 on the housing. This ensures that, when the key is withdrawn, the rollers can move along their respective paths into locking positions.

If provision is required for withdrawal of the key in alternative positions, a corresponding number of recesses similar to the recess 45 would be formed in the housing and a corresponding number of female cam formations similar to the formation 34 would be provided in the sleeve 26.

The lock illustrated in the accompanying drawings may be modified by omitting the cam formation 34 from the ring 32, omitting the complementary cam formation 35 from the outer member and providing an alternative cam mechanism, as now described. In this alternative arrangement, there is disposed outside the sleeve 26 a further sleeve (not shown) constrained to move along the axis 11 and around the axis with the sleeve 26. A pin which is fixed with respect to the outer member 13 projects from the housing 14 into a slot formed in the further sleeve. This slot extends circumferentially of the axis 11 but is non-rectilinear. Movement of the slot over the pin when the key is turned from an initial position causes the sleeve 26 to move along the axis in one direction and movement of the slot over the pin when the key is returned to its initial position causes the sleeve to move along the axis in the opposite direction. Thus, no spring equivalent to the spring 36 is required. The arrangement is such that the key can be withdrawn only when the sleeves have been moved axially to their initial positions. The magnetic elements are then free to move to their locking positions.

I claim:

1. A lock having a plurality of magnetic elements and members defining respective paths along which the magnetic elements can move;

hollow outer member means and an inner member disposed within the outer member means;

the inner member defining a key-receiving opening;

a first path in which a first of the magnetic elements can move between a releasing position and locking position;

the first path being defined by opposing slots in adjoining faces of the inner member and the outer member means;

a second path in which a second of the magnetic elements can move between a releasing position and a locking position;

the second path being defined by opposing slots in adjoining faces of the inner member and the outer member means;

the magnetic elements obstructing operation of the lock when in their locking positions but not when in their releasing positions;

the first magnetic element having a center which defines a first locus, as it moves in the first path;

the second magnetic element having a center which defines a second locus, as it moves in the second path;

the first locus and the second locus each lie in separate planes, and the planes intersect each other perpendicularly; and the first locus is rectilinear and the second locus is curved.

2. A lock having a plurality of magnetic elements and members defining respective paths along which the magnetic elements can move;

the members including a hollow outer member and an inner member partially disposed within the outer member;

the inner member defining a key-receiving opening;

a sleeve member around a portion of the inner member;

a first path in which a first of the magnetic elements can move between a releasing position and locking position;

the first path being defined by opposing slots in adjoining faces of the inner and outer members;

a second path in which a second of the magnetic elements can move between a releasing position and a locking position;

the second path being defined by opposing slots in adjoining faces of the inner member and the sleeve;

the magnetic elements obstructing operation of the lock when in their locking positions but not when in their releasing positions;

the first magnetic element having a center which defines a first locus, as it moves in the first path; and the second magnetic element having center which defines a second locus, as it moves in the second path; and the first locus being rectilinear, the second locus being curved and the first locus being perpendicular to the plane of the second locus.

3. A lock according to claim 1 in which the first path and the second path are positioned with respect to each other such that gravity will cause a magnetic element in one of the paths to assume a locking position at any geometric position at which the lock is placed.

4. A lock having a plurality of magnetic elements and members defining respective paths along which the magnetic elements can move;

the members including a hollow outer member and an inner member partially disposed within the outer member;

the inner member defining a key-receiving opening;

a sleeve member around a portion of the inner member;

a first path in which a first of the magnetic elements can move between a releasing position and locking position;

the first path being defined by opposing slots in adjoining faces of the inner and outer members;

a second path in which a second of the magnetic elements can move between a releasing position and a locking position;

the second path being defined by opposing slots in adjoining faces of the inner member and the sleeve;

the magnetic elements obstructing operation of the lock when in their locking positions but not when in their releasing positions;

the first magnetic element having a center which defines a first locus, as it moves in the first path; and the second magnetic element having a center which defines a second locus, as it moves in the second path; and the first locus and the second locus each lying in separate planes, and the planes intersect each other.

5. A lock according to claim 2 in which the second locus is an arc of a circle.

6. A lock according to claim 5 in which the key-receiving opening is rectilinear and a key when in the opening moves the magnetic elements.

7. A lock having a plurality of magnetic elements and members defining respective paths along which the magnetic elements can move;

the members including a hollow outer member and an inner member partially disposed within the outer member;

the inner member defining a key-receiving opening;

a sleeve member around a portion of the inner member;

a first path in which a first of the magnetic elements can move between a releasing position and locking position;

the first path being defined by opposing slots in adjoining faces of the inner and outer members;

a second path in which a second of the magnetic elements can move between a releasing position and a locking position;

the second path being defined by opposing slots in adjoining faces of the inner member and the sleeve;

the magnetic elements obstructing operation of the lock when in their locking positions but not when in their releasing positions;

the first magnetic element having a center which defines a first locus, as it moves in the first path;

the second magnetic element having a center which defines a second locus, as it moves in the second path; and the second locus being in a plane and the first locus being rectilinear and perpendicular to the plane containing the second locus.

8. A lock having a plurality of magnetic elements and members defining respective paths along which the magnetic elements can move;

hollow outer member means and an inner member disposed within the outer member means;

a first path in which a first of the magnetic elements can move between a releasing position and locking position;

the first path being defined by opposing slots in adjoining faces of the inner member and the outer member means;

a second path in which a second of the magnetic elements can move between a releasing position and a locking position;

the second path being defined by opposing slots in adjoining faces of the inner member and the outer member means;

the first path and the second path each lying in separate planes with the planes intersecting each other;

the magnetic elements obstructing operation of the lock when in their locking positions but not when in their releasing positions; and the first path and the second path are positioned with respect to each other such that gravity will cause a magnetic element in one of the paths to assume a locking position at any geometric position at which the lock is placed.

* * * * *